US006005458A

United States Patent [19]

Buer et al.

[11] Patent Number: 6,005,458

[45] Date of Patent: Dec. 21, 1999

[54] HIGH DENSITY CONNECTOR AND METHOD THEREFOR

[75] Inventors: Kenneth Vern Buer; David Warren Corman; Joel L. Gross, all of Gilbert, Ariz.

[73] Assignee: Motorola, Inc., Schaumburg, Ill.

[21] Appl. No.: 09/086,605

[22] Filed: May 29, 1998

[51] Int. Cl.[6] ..... H01P 1/04

[52] U.S. Cl. ..... 333/248; 333/254; 385/54

[58] Field of Search ..... 333/1, 239, 248, 333/254, 255; 385/54; 439/682, 684

[56] References Cited

U.S. PATENT DOCUMENTS

| | | | |
|---|---|---|---|
| 3,193,792 | 7/1965 | Shea, Jr. | 439/682 |
| 4,279,469 | 7/1981 | Forman | 385/54 X |
| 4,341,439 | 7/1982 | Hodge | 385/54 X |
| 4,686,498 | 8/1987 | Carr et al. | 333/255 X |
| 4,701,731 | 10/1987 | Hanson et al. | 333/248 X |
| 5,297,226 | 3/1994 | Fukunishi | 385/54 |
| 5,600,336 | 2/1997 | Kubo et al. | 333/248 X |

*Primary Examiner*—Paul Gensler

*Attorney, Agent, or Firm*—Dana B. LeMoine; Timothy J. Lorenz

[57] ABSTRACT

A method and apparatus for efficiently interconnecting a large number of high frequency high bandwidth signals includes two interface plates (100, 200), each having two substantially coplanar faces, a mating face (110, 210) and a non-mating face (120, 220). Each interface plate has waveguides (116, 216) disposed between the coplanar faces such that when the mating faces of the interface plates are brought together, a plurality of waveguide connections are made. An energy absorbing gasket (300) having a hole pattern matching the waveguide pattern is disposed between the mating faces of the interface plates so that reflections caused by misalignment and non-coplanarity of faces can be reduced.

15 Claims, 3 Drawing Sheets

HIGH DENSITY CONNECTOR AND METHOD THEREFOR

FIELD OF THE INVENTION

This invention relates in general to the interconnection of signals and, in particular, to the interconnection of a large number of high frequency signals with wide bandwidths.

BACKGROUND OF THE INVENTION

Phased array antenna systems are in widespread use today. These systems generate one or more directional antenna beams by independently adjusting the phase of a number of signals. Each phase shifted signal is coupled to an array element in the antenna such that when the signals are transmitted, a directional wave front is created in the direction that the signals sum in-phase, thereby forming a beam.

Existing phased array antenna systems are typically capable of generating a few directional beams. The number of phase shifted signals necessary to generate the beams is related to the number of beams, so that as the number of beams increases, the number of signals within the system increases. In prior art phased array antenna systems, signals are typically cabled from one subsystem to another. When the system is built, assembly operators manually interconnect the cables. During testing and alignment of the prior art systems, when adjustments are necessary, the assembly operators manually disassemble the cables. Since prior art systems have relatively few cabled connections, this is a reasonably cost effective approach.

Modern communications systems, especially satellite communications systems, have placed increased demands on phased array antenna systems that have resulted in an increase in the number of beams generated by phased array antenna systems. Where prior art systems have only a few beams, modern systems can have as many as a few hundred to a few thousand beams. The prior art method of manually cabling signals is inadequate for the newer systems because of the drastic increase in the number of signals. Given the increased number of signals, it is no longer reasonably cost effective to manually assemble the cabling between subsystems in modern phased array antenna systems.

Fluctuations in gain (or attenuation) can affect the signals within a phased array antenna system. It is desirable to have very low passband slope or ripple across the bandwidth of interest. Cables inherently have some gain fluctuations over frequency, and in prior art systems where the bandwidths are reasonably narrow, cables provide a reasonable solution. In modern systems with wider bandwidths, however, the gain variation of cables can have a detrimental effect on the system. It is desirable, therefore, to be able to quickly connect a large number of signals without introducing significant gain variations over frequency.

What is needed is a method and apparatus for interconnecting a large number of high frequency, wide bandwidth signals without introducing substantial gain variations over frequency. What is also needed is a method and apparatus that allows for the quick mating and de-mating of a large number of high frequency signals.

DETAILED DESCRIPTION OF THE DRAWINGS

Figure 1:
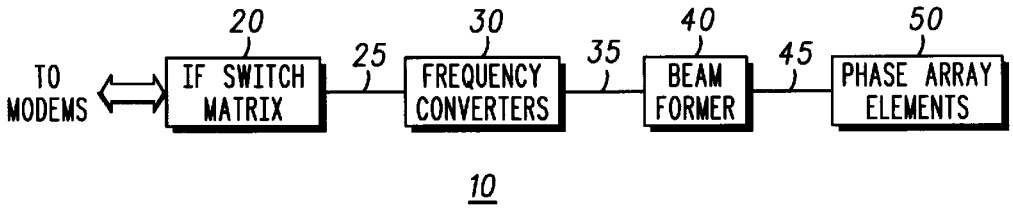
FIG. 1 shows a diagram of a phased array antenna system in accordance with a preferred embodiment of the present invention.

Turning now to the drawings in which like reference characters indicate corresponding elements throughout the several views, attention is first directed to FIG. 1. FIG. 1 shows a diagram of a phased array antenna system in accordance with a preferred embodiment of the present invention. Phased array antenna system 10 includes IF switch matrix 20, frequency converters 30, beam former 40, and phased array elements 50. IF switch matrix 20 communicates with frequency converters 30 via signals 25. Frequency converters 30 communicate with beam former 40 via signals 35. Beam former 40 communicates with phased array elements 50 via signals 45. Phased array antenna system 10 can be used for transmitting signals, or for receiving signals. For ease of explanation, phased array antenna system 10 is herein described as a system used for transmitting signals.

When phased array antenna system 10 is used as a transmitter, IF switch matrix 20 receives signals from modems. IF switch matrix then switches modem signals to appropriate beams for transmission. IF switch matrix 20 outputs signals 25. Each signal within signals 25 represents a separate beam to be transmitted by phased array antenna system 10. For example, if phased array antenna system 10 is to transmit four beams, then signals 25 includes four separate signals. Frequency converters 30 receives signals 25, converts the frequency, and outputs signals 35. The number of signals in signals 35 is typically equal to the number of signals 25. Beam former 40 receives signals 35, which includes a number of signals equal to the number of beams, and creates signals 45, which includes a number of signals equal to the number of elements in phased array elements 50. Each of signals 45 has undergone a phase shift as a result of the operation of beam former 40. Techniques for creating signals 45 with appropriate phase shifts are well known in the art. Phased array elements 50 transmit signals 45 such that directional beams are created in free space, one beam for each of signals 35.

In an exemplary prior art system where the number of beams is four, and the number of phased array elements is one hundred, signals 25 would include four separate signals, signals 35 would include four separate signals, and signals 45 would include one hundred separate signals. In contrast to prior art systems, a preferred embodiment of the present invention includes hundreds of beams, and thousands of elements. In a preferred embodiment, signals 25 includes five hundred signals, signals 35 also includes five hundred signals, and signals 45 includes four thousand signals. Because the number of signals in a preferred embodiment of the present invention is much larger than the number of signals in the prior art, it is desirable to have a method and apparatus to efficiently and quickly mate and de-mate the subsystems and the corresponding large number of signals.

Also in a preferred embodiment of the present invention, the frequency of the signals is much higher than frequencies in prior art systems. For example, in a preferred embodiment of the present invention, signals 25 are two gigahertz and signals 35 and signals 45 are at twenty to thirty gigahertz. In addition to higher frequencies, a preferred embodiment of the present invention employs wider bandwidths than have typically been employed in the prior art. For example, prior art systems typically employ bandwidths of a few megahertz to twenty megahertz, and a preferred embodiment of the present invention employs bandwidths of greater than one gigahertz for signals 25, 35, and 45. Because of wider bandwidths, it is desirable to mate the subsystems shown in FIG. 1 using a method which exhibits a flat passband across a wide bandwidth.

Prior art systems have typically employed discrete cables for connecting the subsystems shown in FIG. 1. With bandwidths of a few megahertz, the prior art systems were able to utilize cabling which exhibits small gain variations over the bandwidth of interest. In a preferred embodiment of the present invention, the prior art solution of cabling is undesirable because of the number of signals, and the large gain variations over the passband of interest. With bandwidths of greater than one gigahertz, a preferred embodiment of the present invention would suffer from undesirable gain variations over the bandwidth of interest if cables were employed.

Figure 2:
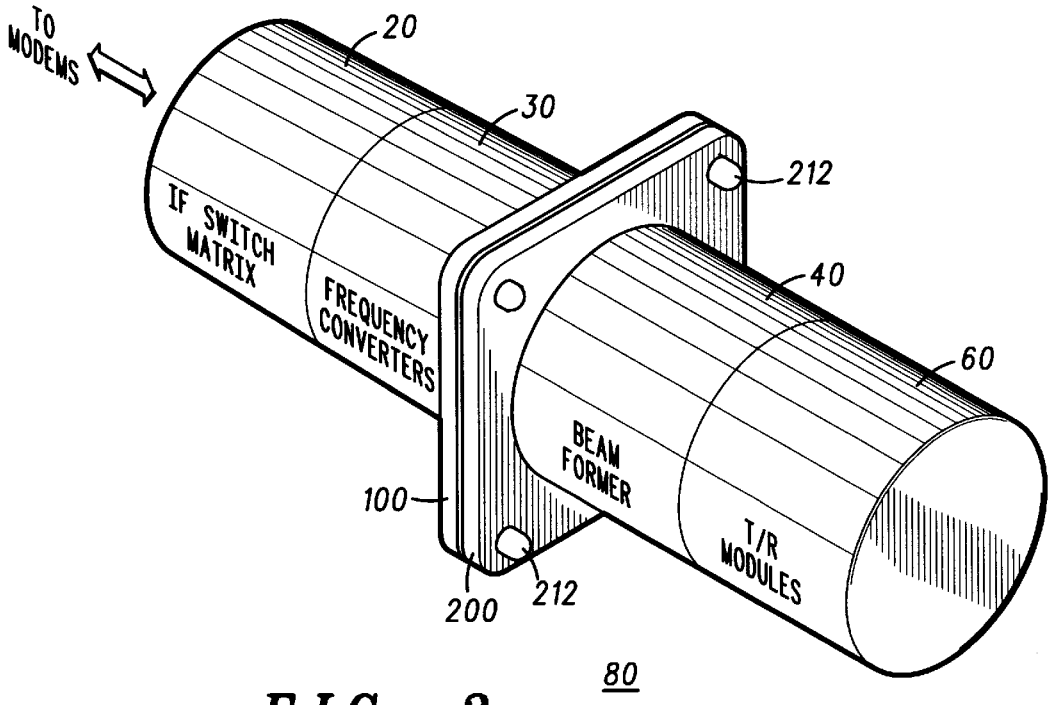
FIG. 2 shows an oblique isometric view of a phased array antenna system in accordance with a preferred embodiment of the present invention.

FIG. 2 shows an oblique isometric view of a phased array antenna system in accordance with a preferred embodiment of the present invention. Phased array antenna system 80 includes IF switch matrix 20, frequency converters 30, beam former 40, and transmit/receive modules 60. Transmit receive/modules 60 of phased array antenna system 80 include phased array elements 50 (FIG. 1).

Also shown in FIG. 2 are interface plates 100 and 200. In a preferred embodiment of the present invention, interface plates 100 and 200 accommodate the connection of a large number of signals between frequency converters 30 and beam former 40. As is described in more detail below, interface plate 100 is attached to frequency converters 30, and interface plate 200 is attached to beam former 40. When interface plates 100 and 200 are brought together, they are fastened at fastening points 212.

Interface plates 100 and 200 are shown in FIG. 2 as effecting the interconnect between frequency converters 30 and beam former 40; however, in an alternate embodiment, interface plates 100 and 200 effect the interface between beam former 40 and transmit/receive modules 60. In the embodiment shown in FIG. 2, phased array antenna system 80 is cylindrical; however, in an alternate embodiment, the phased array antenna system is non-cylindrical. For example, in one alternate embodiment, the phased array antenna system creates a rectangular footprint on interface plates 100 and 200.

In prior art systems, subsystems such as frequency converters 30 and beam former 40 are typically connected with cables. In the embodiment of the present invention exemplified in FIG. 2, interface plates 100 and 200 replace cables as a means for connecting frequency converters 30 and beam former 40.

The method and apparatus of the present invention, as exemplified in FIG. 2, has many advantages. Among these advantages are ease of mating and de-mating of subsystems. For example, to disassemble frequency converters 30 from beam former 40, interface plate 100 is disconnected from interface plate 200 at fastening points 212, thereby effecting the de-mating of the subsystems. Another advantage to the use of interface plates 100 and 200 is thermal transfer. Because interface plates 100 and 200 generally have more thermal mass than cables typically have, they can be utilized as heat sinks.

The method and apparatus of the present invention is applicable to systems other than phased array antenna systems. Phased array antenna system 10 has been chosen as an exemplary application of the method and apparatus of the present invention, in part because in a phased array antenna system, the largest of number of signals are typically also at the highest frequencies. Phased array antenna systems, therefore, are an exemplary application where the method and apparatus of the present invention can be advantageously employed.

Figure 3:
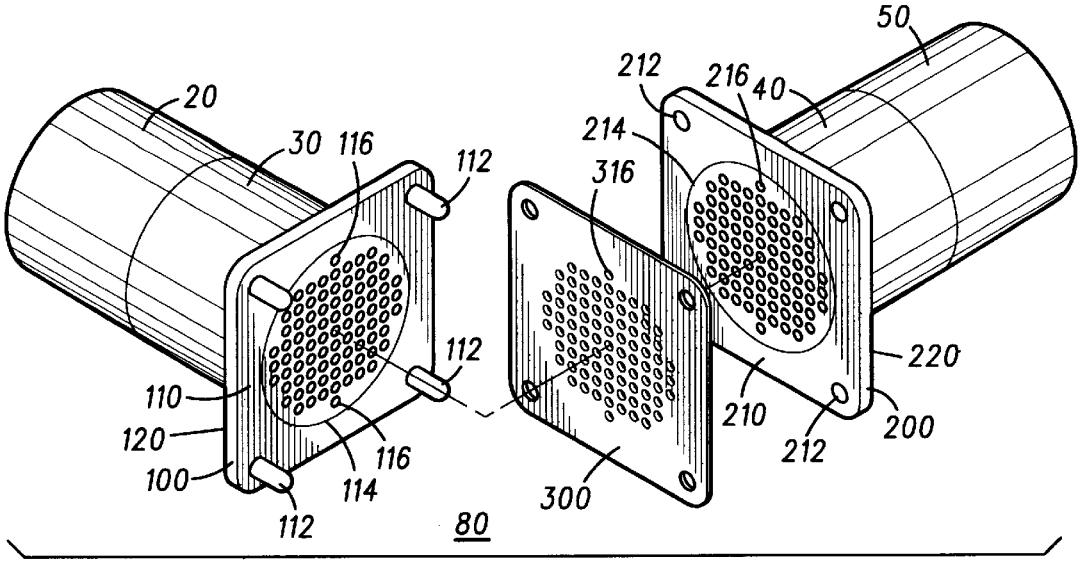
FIG. 3 shows an exploded isometric view of a phased array antenna system in accordance with a preferred embodiment of the present invention.

FIG. 3 shows an exploded isometric view of a phased array antenna system in accordance with a preferred embodiment of the present invention. Phased array antenna system 80 is shown in FIG. 3 with interface plates 100 and 200 disconnected, and oriented so that the mating faces of interface plate 100 and 200 are visible. Interface plate 100 has two substantially coplanar faces, mating face 110 and non-mating face 120. Non-mating face 120 is coupled to a subsystem shown as frequency converters 30 in FIG. 3, and mating face 110 mates with mating face 210 of interface plate 200 when interface plates 100 and 200 are brought together. Interface plate 200 also has a non-mating face. Non-mating face 220 of interface plate 200 is shown in FIG. 3 as coupled to beam former 40.

On mating face 110 of interface plate 100, a number of waveguides 116 are shown within waveguide region 114. In the exemplary embodiment of FIG. 3, waveguide region 114 is substantially circular because of the cylindrical nature of phased array antenna system 80. In an alternate embodiment, waveguide region 114 is non-circular. Waveguides 116 are oriented in interface plate 100 such that they substantially align with waveguides 216 in interface plate 200.

Also shown in FIG. 3 is gasket 300. Gasket 300 includes holes 316 which substantially align with waveguides 216 and waveguides 116. When interface plate 100 and interface plate 200 are brought together with gasket 300 therebetween, a number of waveguide connections are simultaneously made between waveguides 116 and waveguides 216. Gasket 300 is preferably made from material having electromagnetic energy absorbing properties, such as Eccosorb commercially available from Emmerson Cumming. When gasket 300 is made of an absorptive material, greater isolation between adjacent waveguides is provided, even in the absence of absolute coplanarity between mating face 110 and mating face 210. In addition, when slight misalignments occur between interface plate 100 and interface plate 200, absorptive gasket material lessens the impact of abrupt discontinuities in the waveguides created at the junction between waveguides 116 and waveguides 216. When gasket 300 is made of absorptive material some signal losses may occur; however, in exchange for these signal losses, the ability to efficiently mate a large number of signals simultaneously is achieved.

In applications where signal losses due to absorptive gasket material are intolerable, gasket 300 can be manufactured from material with electromagnetic reflective properties. In these applications, alignment between interface plate 100 and interface plate 200 becomes more desirable, as does the coplanarity of mating face 110 and mating face 210.

In a preferred embodiment, gasket 300 is premolded and inserted between mating face 110 and mating face 210 prior to the connection of interface plate 100 and interface plate 200. In an alternate embodiment, gasket 300 is screen printed on mating face 210 of interface plate 200, or on mating face 110 of interface plate 100. In yet another alternate embodiment, gasket 300 is partially screen printed on mating face 210 of interface plate 200, and partially screen printed on mating face 110 of interface plate 100. In this alternate embodiment, both mating faces have gasket material disposed thereon, so that when interface plate 100 and interface plate 200 are brought together, gasket 300 is made up of the gasket material disposed on both mating faces.

In a preferred embodiment, waveguides 116 and 216 are circular. In an alternate embodiment, waveguides 116 and 216 are noncircular. Examples of noncircular waveguides include rectangular waveguides and ridged waveguides. Fastening points 212 are shown sparsely distributed about interface plates 100 and 200 in FIG. 3. Depending on the size of interface plates 100 and 200, and the size of waveguide regions 114 and 214, more fastening points 112 and 212 may be necessary, including at points within waveguide regions 114 and 214.

The method and apparatus of the present invention as shown in FIG. 3 and described with reference thereto, has many advantages. A large number of high frequency signals are quickly and reliably connected when interface plate 100 and interface plate 200 come together. Accordingly, large systems can advantageously utilize the method and apparatus of the present invention during manufacturing and integration. In addition to providing reliable high frequency interconnections, the method and apparatus of the present invention advantageously provides subsystem connections having small gain variations over large bandwidths.

Figure 4:
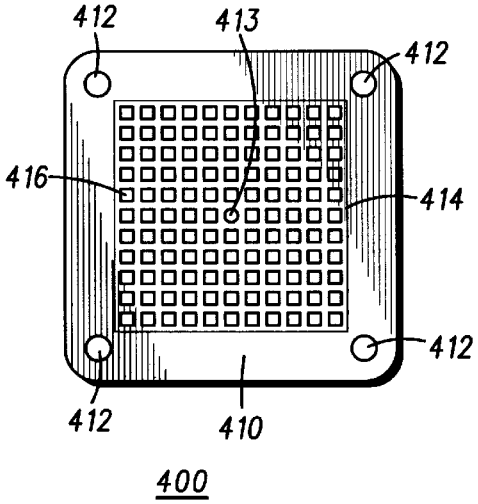
FIG. 4 shows an orthogonal view of an interface plate in accordance with a preferred embodiment of the present invention.

FIG. 4 shows an orthogonal view of an interface plate in accordance with a preferred embodiment of the present invention. Mating face 410 of interface plate 400, as shown in FIG. 4, includes waveguide region 414, waveguides 416, and fastening points 412 and 413. Interface plate 400 has a rectangular waveguide region, shown as waveguide region 414 in FIG. 4. The size and shape of waveguide region 414 is not a limitation of the present invention. Instead, the size and shape of waveguide region 414 is easily modifiable as a function of the interconnect needs of the system.

Waveguides 416 are rectangular; however, other types of waveguides can be used. For example, waveguides 416 can be square, circular, ridged, or any other waveguide shape. Five fastening points 412, 413 are shown on interface plate 400. More or less fastening points can be used depending on the size of waveguide region 414, the coplanarity of interface plates, and the isolation requirements between adjacent waveguides. When additional fastening points are desirable, fastening points can be included within waveguide region 414, such as fastening point 413. Any number of fastening points 413 can be included within waveguide region 414.

Fastening points can be holes, threaded holes, guide pins, or any other void or obtrusion functioning as an aid to alignment or attachment between interface plates. In a preferred embodiment, fastening points 412 are holes so that mating interface plates can be manufactured identically. When fastening points 412 are holes, bolts or other suitable fasteners are used to attach mating interface plates.

Figure 5:
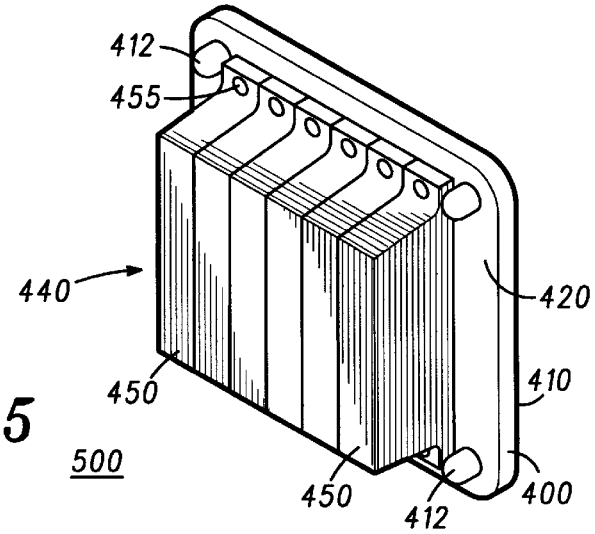
FIG. 5 shows an isometric view of an interface plate coupled to a subsystem in accordance with a preferred embodiment of the present invention.

FIG. 5 shows an isometric view of an interface plate coupled to a subsystem in accordance with a preferred embodiment of the present invention. Non-mating face 420 of interface plate 400 is coupled to subsystem 440. Subsystem 440 can be one large subsystem which mates to interface plate 400 as a single block; however, subsystem 440 is preferably made up of smaller circuits within circuit housings 450 which are attached to interface plate 400 separately. Circuit housings 450 are attached to interface plate 400 at fastening points 455. In an exemplary embodiment, subsystem 440 is frequency converters 30 (FIG. 2). In other exemplary embodiments, subsystem 440 can be beam former 40 or transmit receive modules 60 (FIG. 2). In still further embodiments, subsystem 440 can be any other subsystem that benefits from the advantages of interface plate 400.

Interface plate 400 is advantageous in part because it provides a substrate onto which subsystem 440 can be integrated. As subsystem 440 is integrated, circuit housings 450 are connected to interface plate 400. After subsystem 440 is integrated, interface plate 400 provides a quick and reliable method for mating subsystem 440 with another subsystem, thereby aiding in the manufacturing and integration processes.

Figure 6:
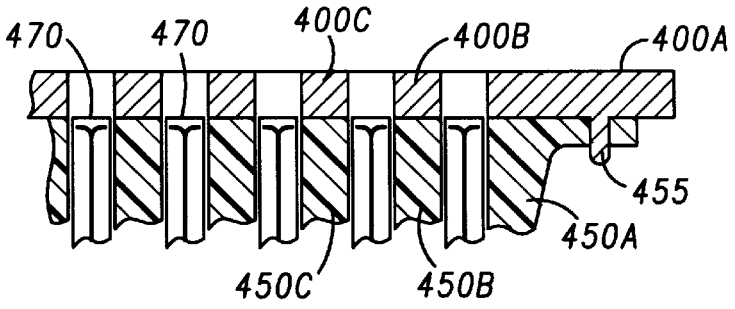
FIG. 6 shows a cutaway view of the apparatus of FIG. 5 in accordance with a preferred embodiment of the present invention.

FIG. 6 shows a cut-away view of the apparatus of FIG. 5 in accordance with a preferred embodiment of the present invention. As shown in FIG. 6, interface plate 400 and circuit housing 450 are cut away showing the internals of the waveguides and the circuit with which it communicates. Cut away portions of interface plate 400 include 400A, 400B, and 400C. Cut away portions of circuit housing 450 include 450A, 450B, and 450C. Circuit housing 450 includes transitions 470, which in a preferred embodiment are manufactured on circuit cards which do not protrude into the waveguides. When transitions 470 are recessed into circuit housing 450 as shown in FIG. 6, the transitions are less likely to be damaged during assembly. In an alternate embodiment, transitions 470 protrude beyond circuit housing 450 and into the waveguide. Other circuits useful for transitioning signal propagation from circuit cards and cables to waveguides and vice versa are well known in the art. The type of transition used to communicate with the waveguides is not a limitation of the present invention.

Figure 7:
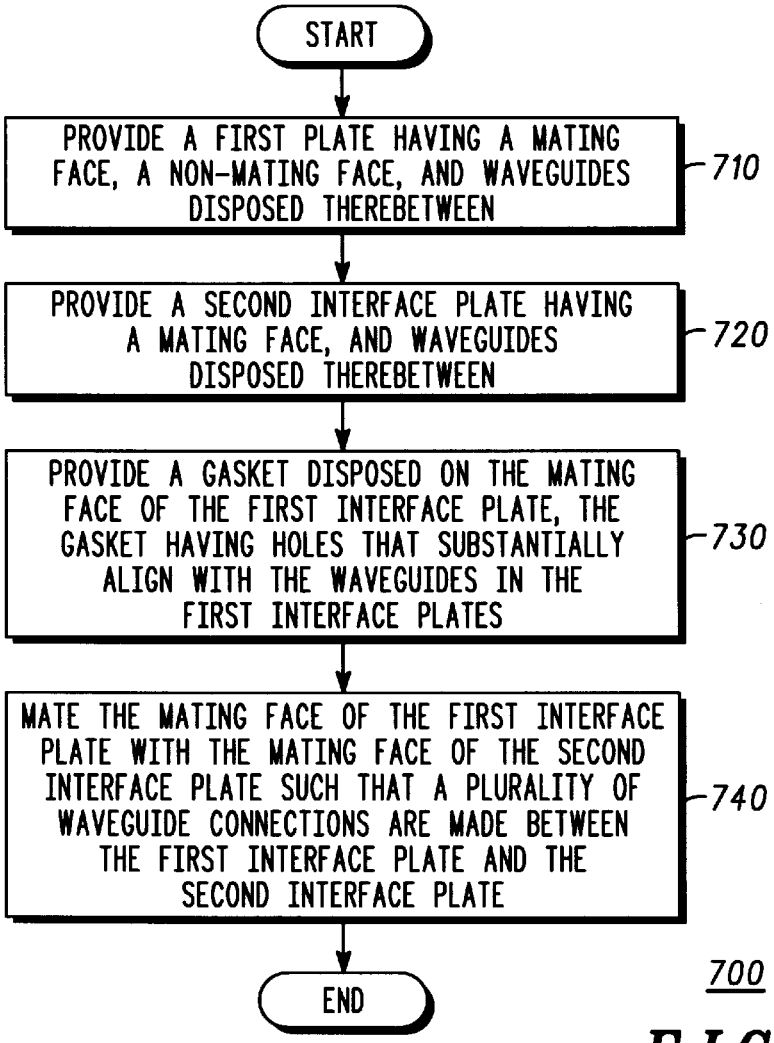
FIG. 7 shows a flowchart of a method of making a plurality of waveguide connections in accordance with a preferred embodiment of the present invention.

FIG. 7 shows a flow chart of a method of making a plurality of waveguide connections in accordance with a preferred embodiment of the present invention. Method 700 begins with step 710 when a first interface plate is provided having a mating face, a non-mating face, and waveguides disposed therebetween. In step 720, a second interface plate is provided which has a mating face, a non-mating face, and waveguides disposed therebetween. In step 730, a gasket is disposed on the mating face of the first interface plate. The gasket of step 730 has holes that substantially align with the waveguides in the first interface plate. The gasket can be predisposed on the mating face, using a printing technique, or alternately, the gasket can be premolded and placed on the mating face of the interface plate. Then, in step 740, the mating face of the first interface plate is mated with the mating face of the second interface plate, such that the waveguides in the first interface plate and the waveguides in the second interface plate form waveguide connections.

In summary, the method and apparatus of the present invention provides an advantageous means for connecting a large number of high frequency signals reliably and efficiently. Waveguides provide a flatter passband response than cables and so are advantageously used to interconnect large bandwidth signals. A gasket preferably having energy absorptive properties is used to absorb reflections caused by slight mismatches caused by alignment and coplanarity problems.

While we have shown and described specific embodiments of the present invention, further modifications and improvements will occur to those skilled in the art. For example, the specific embodiments have been described in the context of phased array antenna systems. One skilled in the art will appreciate that the number of signals, and the bandwidth of those signals, is increasing in many different types of modern systems, and that the method and apparatus of the present invention is applicable to those systems as well as phased array antenna systems. We desire it to be understood, therefore, that this invention is not limited to the particular forms shown and we intend in the appended claims to cover all modifications that do not depart from the spirit and scope of this invention.

What is claimed is:

1. An apparatus comprising:

a first interface plate having a first mating face, a first non-mating face, a first plurality of waveguides disposed therebetween, a waveguide region defined by the smallest circle on said first mating face that encompasses all of said first plurality of waveguides, a first plurality of fastening points dispersed about said first mating face outside said waveguide region, and at least one fastening point dispersed within said waveguide region; and a second interface plate having a second mating face, a second non-mating face, and a second plurality of waveguides disposed therebetween, wherein said first plurality of waveguides substantially aligns with said second plurality of waveguides such that when said first mating face and said second mating face are brought together, a plurality of waveguide connections are made.

2. The apparatus of claim 1 wherein said first plurality of fastening points are holes for receiving fastening devices.

3. The apparatus of claim 1 wherein said second mating face includes a second plurality of fastening points which substantially align with said first plurality of fastening points when said first mating face and said second mating face are brought together.

4. An apparatus comprising:

a first interface plate having a first mating face, a first non-mating face, a first plurality of waveguides disposed therebetween;

a second interface plate having a second mating face, a second non-mating face, and a second plurality of waveguides disposed therebetween, wherein said first plurality of waveguides substantially aligns with said second plurality of waveguides such that when said first mating face and said second mating face are brought together, a plurality of waveguide connections are made; and a gasket having a plurality of holes aligned such that when said gasket is placed on said first mating face, said plurality of holes substantially aligns with said first plurality of waveguides.

5. The apparatus of claim 4 wherein said gasket has electromagnetic energy absorbing properties.

6. The apparatus of claim 4 wherein said gasket has electromagnetic energy reflecting properties.

7. The apparatus of claim 4 wherein said first plurality of waveguides and said second plurality of waveguides are circular waveguides.

8. An apparatus comprising:

a first interface plate having a first mating face, a first non-mating face, a first plurality of non-circular waveguides disposed therebetween; and a second interface plate having a second mating face, a second non-mating face, and a second plurality of non-circular waveguides disposed therebetween, wherein said first plurality of non-circular waveguides substantially aligns with said second plurality of non-circular waveguides such that when said first mating face and said second mating face are brought together, a plurality of waveguide connections are made.

9. The apparatus of claim 8 wherein said first plurality of non-circular waveguides and said second plurality of non-circular waveguides are rectangular waveguides.

10. The apparatus of claim 8 wherein said first plurality of non-circular waveguides and said second plurality of non-circular waveguides are square waveguides.

11. A method of making a plurality of waveguide connections, said method comprising the steps of:

(a) providing a first interface plate having a mating face, a non-mating face, and a first plurality of waveguides disposed therebetween;

(b) providing a second interface plate having a mating face, a non-mating face, and a second plurality of waveguides disposed therebetween, wherein a subset of said first plurality of waveguides substantially aligns with a corresponding subset of said second plurality of waveguides;

(c) mating the mating face of said first interface plate with the mating face of said second interface plate such that said plurality of waveguide connections are made; and (d) providing a gasket disposed on said mating face of said first interface plate prior to step (c), said gasket having holes therein, said holes being substantially aligned with said first plurality of waveguides.

12. The method of claim 11 wherein said first plurality of waveguides and said second plurality of waveguides are circular waveguides.

13. The method of claim 11 wherein said first plurality of waveguides and said second plurality of waveguides are non-circular waveguides.

14. The method of claim 11 wherein said first plurality of waveguides and said second plurality of waveguides are rectangular waveguides.

15. The method of claim 11 wherein said first plurality of waveguides and said second plurality of waveguides are square waveguides.

* * * * *